US011398665B2

(12) United States Patent
Yoo et al.

(10) Patent No.: US 11,398,665 B2
(45) Date of Patent: Jul. 26, 2022

(54) HEAT-RADIATING MECHANISM FOR ANTENNA DEVICE

(71) Applicant: KMW INC., Hwaseong-si (KR)

(72) Inventors: Chang Woo Yoo, Hwaseong-si (KR); Min Sik Park, Hwaseong-si (KR); Jun Woo Yang, Hyangnam-eup (KR)

(73) Assignee: KMW, INC., Hwaseong-si (KR)

( * ) Notice: Subject to any disclaimer, the term of this patent is extended or adjusted under 35 U.S.C. 154(b) by 68 days.

(21) Appl. No.: 17/106,100

(22) Filed: Nov. 28, 2020

(65) Prior Publication Data

US 2021/0083356 A1 Mar. 18, 2021

Related U.S. Application Data

(63) Continuation of application No. PCT/KR2019/006458, filed on May 29, 2019.

(30) Foreign Application Priority Data

May 31, 2018 (KR) ..... 10-2018-0062284

(51) Int. Cl.
*H01Q 1/02* (2006.01)
*H01Q 1/44* (2006.01)

(52) U.S. Cl.
CPC ..... *H01Q 1/02* (2013.01); *H01Q 1/44* (2013.01)

(58) Field of Classification Search
CPC .. H01Q 1/2283; H01Q 9/0407; H01Q 1/2291; H01Q 1/44; H01Q 23/00;
(Continued)

(56) References Cited

U.S. PATENT DOCUMENTS

2009/0262505 A1* 10/2009 Lin ..... H01L 23/467 361/709
2013/0223012 A1* 8/2013 Pierides ..... H05K 7/20409 165/185
2018/0316086 A1* 11/2018 Lehman ..... H01Q 21/26

FOREIGN PATENT DOCUMENTS

JP 2008-310572 A 12/2008
JP 2014-22680 A 2/2014
(Continued)

OTHER PUBLICATIONS

International Search Report for PCT/KR2019/006458 dated Aug. 29, 2019 and its English translation.
(Continued)

*Primary Examiner* — Monica C King
(74) *Attorney, Agent, or Firm* — Insight Law Group, PLLC; Seung Lee

(57) ABSTRACT

The present disclosure relates to a heat-radiating mechanism for an antenna device, and particularly, includes: a plurality of communication elements generating predetermined heat upon electrical operation, a heat-radiating combined case having the plurality of communication elements accommodated in one surface thereof and a plurality of heat-radiating ribs integrally formed on the other surface thereof, and an antenna board mounted with the plurality of communication elements on one surface of the heat-radiating combined case, in which the plurality of heat-radiating ribs are formed such that the rising airflow formed by being heat-radiated from the relatively lower portion of the heat-radiating combined case is exhausted to be inclined upward to the left and right outsides of the heat-radiating combined case in the width direction from the relatively upper position, thereby improving the heat-radiating performance of the antenna device.

8 Claims, 8 Drawing Sheets

(58) Field of Classification Search
CPC .. H01Q 9/16; H01Q 1/02; H01Q 9/42; H01Q 1/1221; H01Q 1/2225; H01Q 1/246; H01Q 1/36; H01Q 13/10; H01Q 13/18; H01Q 21/24; H01Q 21/28; H01Q 5/371; H01Q 5/378; H01Q 5/392; H01Q 5/40; H01Q 7/00; H01Q 9/30; H01Q 1/04; H01Q 1/18; H01Q 1/243; H01Q 1/26; H01Q 1/288; H01Q 1/425; H01Q 1/46; H01Q 1/48; H01Q 1/523; H01Q 11/16; H01Q 11/18; H01Q 13/00; H01Q 13/28; H01Q 15/0093; H01Q 21/00; H01Q 21/064; H01Q 21/065; H01Q 3/08; H01Q 3/18; H01Q 3/24; H01Q 5/307; H01Q 5/342; H01Q 5/35; H01Q 9/0414; H01Q 9/0421; H01Q 9/0457; H01Q 9/0485; H01Q 9/40; H01Q 11/14; H01Q 9/285; H05K 7/20154; H05K 7/20163; H05K 7/14; H05K 7/20; H05K 7/20136; H05K 7/20209; H05K 7/20409; H05K 7/20545; H05K 7/20563; H05K 7/20572
See application file for complete search history.

(56) References Cited

FOREIGN PATENT DOCUMENTS

| | | | |
|---|---|---|---|
| JP | 2018-064205 | A | 4/2018 |
| KR | 10-2016-0121491 | A | 10/2016 |
| KR | 10-2018-0055770 | A | 5/2018 |
| WO | 2018-093173 | A1 | 5/2018 |

OTHER PUBLICATIONS

First office action dated Jan. 5, 2022 for Japanese Application No. 2020-566745.

* cited by examiner

FIG. 6

❑ Analysis Conditions

| Items | Heat sink Shape | Remarks |
|---|---|---|
| Physical Dimension [ W*H*D, mm ] | 180.0 x 2000.0 x 62.0 | without Mount Bracket |
| Cooling Method | Natural Convection Cooling | No wind effect |
| Ambient Temperature & Fluid | Air at 20 ℃ | |
| Material | Heat sink | Aluminum : A6063 |
| | Casting | ALDC 12.1 |
| Software | 6Sigma ET | Future facilities |

❑ Heat Emission

| Unit | FPGA(7 EA, Ideal contact) | RFIC (21EA, Ideal contact) | Total |
|---|---|---|---|
| Heat Emission [ W ] | 350 (50W/ea) | 126 (6W/ea) | 476 |

⑦ ⑥ ⑤ ④ ③ ② ①

| No. | Comp. | Model 1 | Ta | ΔT (Model 1- Ta) | Model 2 | Ta | ΔT (Model 2- Ta) | ΔT (Model 2-Model 1) | Model 3 | Ta | ΔT (Model 3- Ta) | ΔT (Model 3 - Model 1) |
|---|---|---|---|---|---|---|---|---|---|---|---|---|
| 1 | FPGA | 70.1 | 48.6 | 21.5 | 66.6 | 47.7 | 18.9 | -3.5 | 68.3 | 51.5 | 16.8 | -1.8 |
| 2 | | 71.3 | 52.9 | 18.4 | 65.7 | 47.1 | 18.6 | -5.6 | 69.7 | 54.3 | 15.4 | -1.6 |
| 3 | | 72.7 | 55.2 | 17.5 | 65.3 | 46.8 | 18.5 | -7.4 | 70.7 | 56.0 | 14.7 | -2.0 |
| 4 | | 73.8 | 57.2 | 16.6 | 64.9 | 46.5 | 18.4 | -8.9 | 71.0 | 56.8 | 14.2 | -2.8 |
| 5 | | 74.6 | 58.6 | 16.0 | 64.6 | 45.1 | 19.5 | -10.0 | 71.2 | 57.2 | 14.0 | -3.4 |
| 6 | | 75.1 | 59.3 | 15.8 | 64.8 | 44.8 | 20.0 | -10.3 | 71.3 | 57.4 | 13.9 | -3.8 |
| 7 | | 76.2 | 60.2 | 16.0 | 65.8 | 45.3 | 20.5 | -10.4 | 71.6 | 57.3 | 14.3 | -4.6 |

| R ja /200 mm | | | |
|---|---|---|---|
| | Model 1 | Model 2 | Model 3 |
| 1 | 2.32 | 2.65 | 2.98 |
| 2 | 2.72 | 2.69 | 3.25 |
| 3 | 2.85 | 2.70 | 3.40 |
| 4 | 3.01 | 2.72 | 3.52 |
| 5 | 3.13 | 2.56 | 3.57 |
| 6 | 3.16 | 2.50 | 3.60 |
| 7 | 3.13 | 2.44 | 3.50 |
| Total | 20.33 | 18.26 | 23.81 |
| Average | 2.90 | 2.61 | 3.40 |

HEAT-RADIATING MECHANISM FOR ANTENNA DEVICE

CROSS-REFERENCE TO RELATED APPLICATIONS

This application is a continuation application of International Application No. PCT/KR2019/006458, filed on May 29, 2019, which claims priority and benefits of Korean Application No. 10-2018-0062284, filed on May 41, 2018, the content of which are incorporated herein by reference in their entirety.

TECHNICAL FIELD

The present disclosure relates to a heat-radiating mechanism for an antenna device, and more specifically, to a heat-radiating mechanism for an antenna device, which may minimize the influence of a rising airflow formed on the lower end of a heat-radiating combined case formed to be vertically elongated, thereby implementing uniform heat-radiating performance.

BACKGROUND ART

A distributed antenna system is an example of a relay system for relaying the communication between a base station and a user terminal, and utilized in terms of the expansion of the service coverage of the base station so as to provide a mobile communication service up to a shaded area inevitably occurring in an indoor or an outdoor.

The distributed antenna system serves to receive a base station signal from the base station to perform a signal processing such as amplification and then transmit the signal-processed base station signal to a user terminal within the service area based on a downlink path, and to perform the signal processing, such as amplification, for a terminal signal transmitted from the user terminal within the service area and then transmit the signal-processed terminal signal to the base station based on an uplink path, and to implement the relay role of the distributed antenna system, the matching of signals transmitted and received between the base station and the distributed antenna system, for example, the power adjustment of the signal or the like is essential, and to this end, a base station signal matching device is used.

The base station signal matching device adjusts the base station signal having a high power level in the downlink path to a proper power level required for the distributed antenna system, and at this time, as a considerable amount of heat is generated, there are problems in that the base station signal matching device is damaged and the lifespan is shortened, such that a method capable of efficiently discharging the generated heat is required.

FIG. 1 is a front diagram and a back diagram illustrating an example of an antenna device according to the related art.

As illustrated in FIG. 1, an antenna device 1 according to an example of the related art is provided with a plurality of communication elements 12 including an antenna element (not illustrated), an FPGA 13, and an RFIC therein (although not illustrated in FIG. 1, the plurality of communication elements are shielded from the outside by a cover member such as a radome), and includes a case body 10 provided to be installed and fixed on an antenna installation support (not illustrated).

In recent years, as a multiple input multiple output (MIMO) technology with a spatial multiplexing technique in which a transmitter transmits different data through each transmission antenna, and a receiver distinguishes the transmission data through an appropriate signal processing is being developed as a technology of dramatically increasing the data transmission amount using a plurality of antenna elements, the plurality of communication elements 12 are arranged inside one case body 10, whereas the case body 10 is formed to be vertically elongated such that the surface to which the antenna element is attached is inclined approximately downward in order to improve signal performance for a plurality of user terminals.

As an example in which the antenna device according to the related art illustrated in FIG. 1 adopts the case body 10 having the form designed to be vertically elongated, the vertically longitudinal slim-type case body 10 is integrally formed with a plurality of heat-radiating ribs 20 disposed to be vertically elongated on the back surface thereof to effectively heat-radiate the heat generated by the communication elements 12 including the plurality of antenna elements.

However, since the antenna device 1 according to the example of the related art is formed with the plurality of heat-radiating ribs 20 to be vertically elongated, when the heat generated by the communication elements 13, 14 provided on the lower side of the antenna device is radiated by the plurality of heat-radiating ribs 20 provided on the lower side thereof, the temperature is increased by being heat-exchanged with the outside air to form the rising airflow along the heat-radiating rib 20 provided on the upper side of the antenna device, and the rising airflow affects the heat-radiating property of the heat-radiating rib 20 of the plurality of heat-radiating ribs 20, particularly, provided on the upper side, such that the vertical heat-radiating deviation between the plurality of heat-radiating ribs 20 may seriously occur. There may cause a problem in that the vertical heat-radiating deviation according to the heights of the plurality of heat-radiating ribs 20 eventually causes the non-uniformity of communication performance, thereby causing poor communication. Detailed experimental data about the heat-radiating deviation of the antenna device 1 according to the example of the related art may be understood more clearly with reference to FIG. 7 provided for describing an exemplary embodiment of the present disclosure.

DISCLOSURE

Technical Problem

The present disclosure is devised to solve the above problems, and an object of the present disclosure is to provide a heat-radiating mechanism for an antenna device, which may minimize a vertical heat-radiating deviation in an antenna device composed of a vertically longitudinal slim-type case body, thereby improving antenna performance.

Technical Solution

A heat-radiating mechanism for the antenna device according to an exemplary embodiment of the present disclosure includes: a plurality of communication elements generating predetermined heat upon electrical operation, a heat-radiating combined case having the plurality of communication elements accommodated in one surface thereof and a plurality of heat-radiating ribs integrally formed on the other surface thereof, and formed to be vertically and longitudinally elongated, and an antenna board mounted with the plurality of communication elements on one surface of the heat-radiating combined case, in which the plurality of heat-radiating ribs may be formed such that the rising airflow formed by being heat-radiated from the relatively lower portion of the heat-radiating combined case is exhausted to be inclined upward to the left and right outsides of the heat-radiating combined case in the width direction from the relatively upper position.

Here, the plurality of heat-radiating ribs may include: a plurality of extrusion heat-radiating ribs disposed in multiple stages to be vertically spaced apart from each other at a predetermined distance such that an empty space is formed in each of one side and the other side of the heat-radiating combined case in the width direction and a plurality of casting heat-radiating ribs produced by a die casting method to be coupled to the empty space between the plurality of extrusion heat-radiating ribs, and having a plurality of inclined ribs disposed to be inclined upward to the left and right outsides of the heat-radiating combined case in the width direction, respectively, with respect to the center.

Further, the plurality of extrusion heat-radiating ribs of the plurality of heat-radiating ribs may be disposed to be spaced apart from each other at a first separation distance in the width direction of the heat-radiating combined case, and the plurality of casting heat-radiating ribs may be disposed to be spaced apart from each other at a second separation distance at which each lower end of the casting heat-radiating ribs is connected to each front end of the plurality of extrusion heat-radiating ribs.

Further, the plurality of casting heat-radiating ribs of the plurality of heat-radiating ribs may be extensively formed such that each upper end is matched to one end and the other end of the heat-radiating combined case in the width direction.

Further, at least one of the plurality of casting heat-radiating ribs may be disposed to connect the lower end of each rib of the plurality of extrusion heat-radiating ribs disposed on the upper portions thereof.

Further, the empty space formed between the plurality of extrusion heat-radiating ribs may be formed in a triangular shape.

Further, the plurality of casting heat-radiating ribs may include: a first rib group filled in one side empty space formed in the triangular shape on one side of the heat-radiating combined case in the width direction and a second rib group filled in the other side empty space formed in the triangular shape on the other side of the heat-radiating combined case in the width direction, in which the first rib group and the second rib group may be integrally molded by a die casting.

Further, a shape of the lower end formed by each rib of the plurality of extrusion heat-radiating ribs may be provided in a 'V' shape, and two ribs of the plurality of casting heat-radiating ribs disposed on the uppermost end thereof may be provided in a 'V' shape to connect each lower end of the plurality of extrusion heat-radiating ribs.

Advantageous Effects

The heat-radiating mechanism for the antenna device according to the exemplary embodiment of the present disclosure may reduce the heat-radiating deviation of the vertically longitudinal slim-type case formed to be vertically and longitudinally elongated, thereby implementing more improved heat-radiating performance.

DESCRIPTION OF DRAWINGS

FIG. 6 is a table illustrating experimental conditions for comparing the heat-radiating performance of the heat-radiating mechanism for the antenna device according to the present disclosure.

BEST MODE

Figure 1:
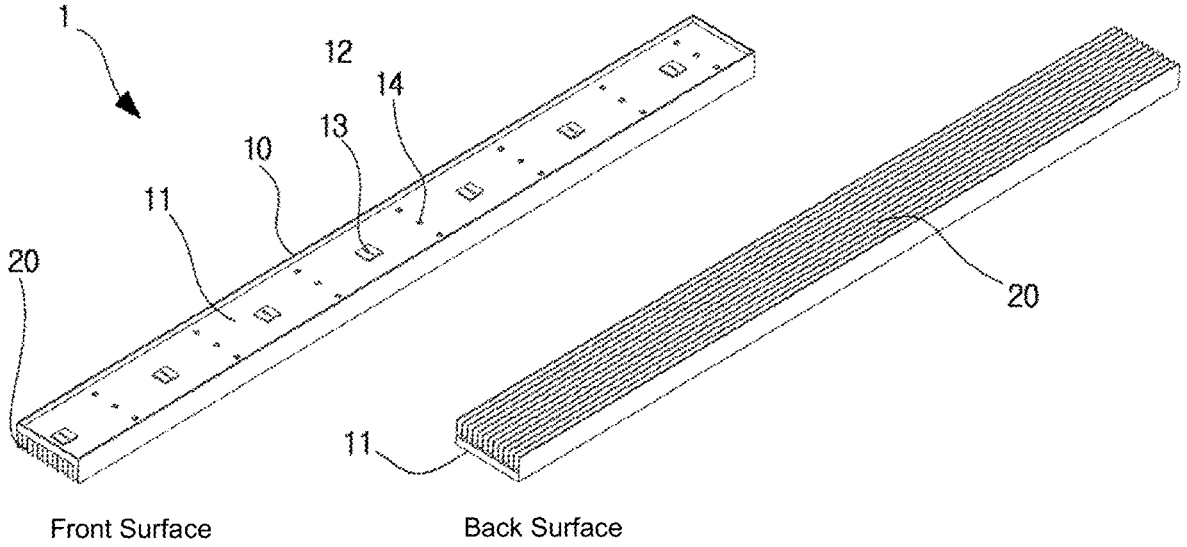
FIG. 1 is a back diagram and a front diagram illustrating an example of a heat-radiating mechanism for an antenna device according to the related art.

Hereinafter, some exemplary embodiments of the present disclosure will be described in detail through exemplary drawings.

In adding reference numerals to components of each drawing, it should be noted that the same components are denoted by the same reference numerals as possible even if they are indicated on different drawings. Further, in describing an exemplary embodiment of the present disclosure, when it is determined that a detailed description of the related known configurations or functions interferes with the understanding of the exemplary embodiment of the present disclosure, the detailed description thereof will be omitted.

In describing the components of the exemplary embodiment of the present disclosure, terms such as first, second, A, B, (a), and (b) may be used. These terms are only for distinguishing the component from other components, and the nature, sequence, or order of the component is not limited by the term. Further, unless otherwise defined, all terms including technical or scientific terms used herein have the same meaning as commonly understood by those skilled in the art to which the present disclosure pertains. Terms such as those defined in commonly used dictionaries should be interpreted as having the meaning consistent with the meaning in the context of the related technology, and should not be interpreted as an ideal or excessively formal meaning unless explicitly defined in the present application.

Figure 2:
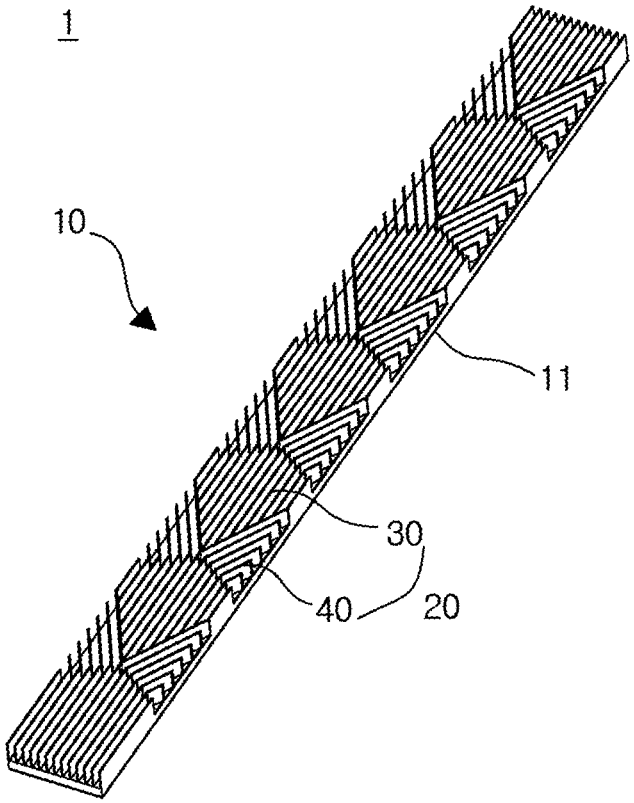
FIG. 2 is a perspective diagram illustrating a heat-radiating mechanism for an antenna device according to an exemplary embodiment of the present disclosure.
Figure 3:
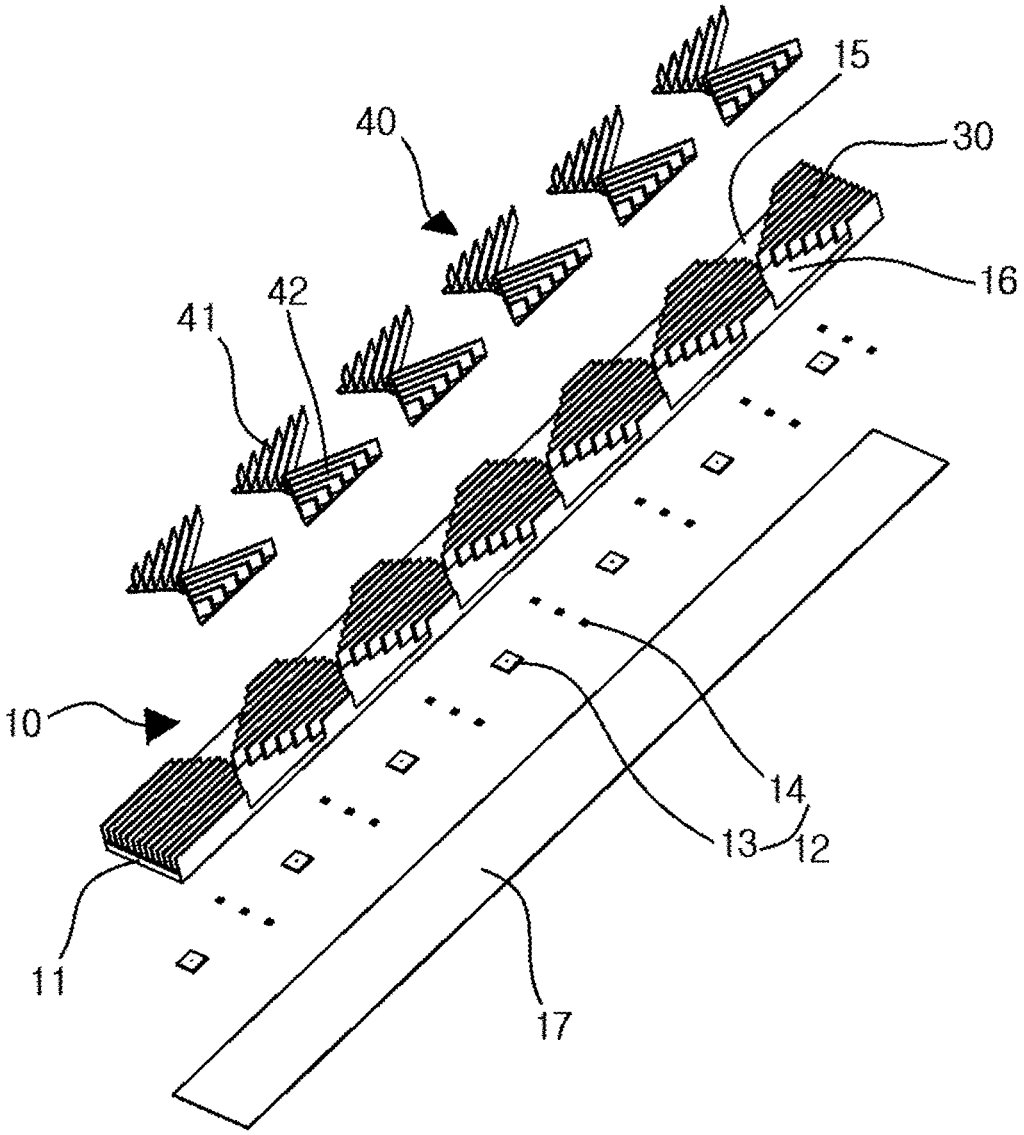
FIG. 3 is an exploded perspective diagram of FIG. 2.
Figure 4:
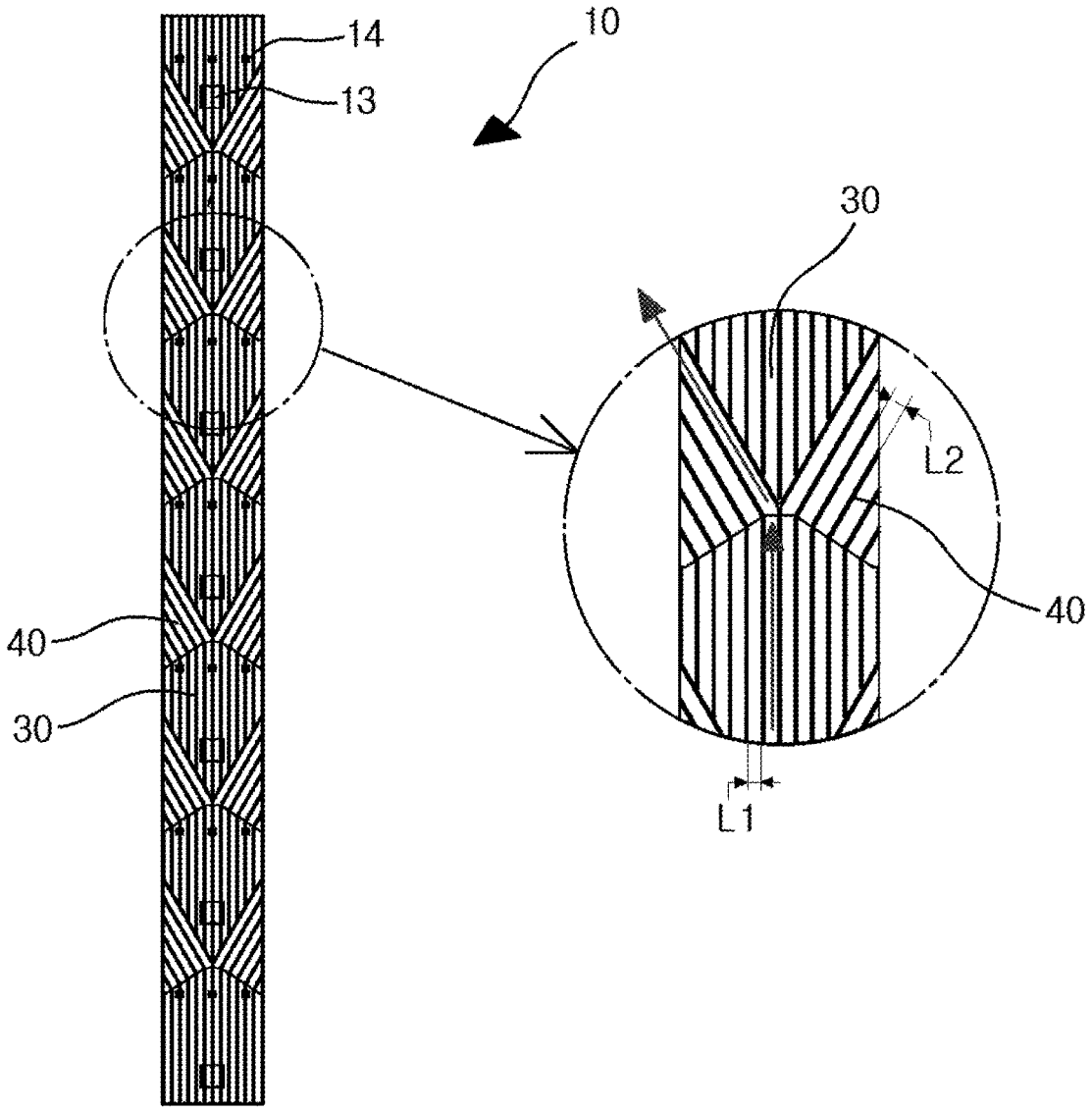
FIG. 4 is a back diagram of FIG. 2 and a partially enlarged diagram thereof

FIG. 2 is a perspective diagram illustrating a heat-radiating mechanism for an antenna device according to an exemplary embodiment of the present disclosure, FIG. 3 is an exploded perspective diagram of FIG. 2, and FIG. 4 is a back diagram of FIG. 2 and a partially enlarged diagram thereof.

As illustrated in FIGS. 2 to 4, a heat-radiating mechanism 1 for an antenna device according to an exemplary embodiment of the present disclosure includes a plurality of communication elements 12 generating predetermined heat upon electrical operation, a heat-radiating combined case having the plurality of communication elements 12 accommodated in one surface thereof, and a plurality of heat-radiating ribs (see reference numerals 30 and 40 in FIG. 3) integrally formed on the other surface thereof, and an antenna board 17 coupled to one surface of the heat-radiating combined case 10 to cover the plurality of communication elements 12.

Particularly, in the heat-radiating mechanism 1 for the antenna device according to the exemplary embodiment of the present disclosure, the heat-radiating combined case 10 may be produced as a vertically longitudinal slim-type case in which the plurality of communication elements 12 are disposed to be spaced apart from each other to be vertically elongated, and the length of the vertical height is relatively larger than the length of the width.

Further, the plurality of communication elements 12 may be a plurality of antenna elements (not illustrated) disposed to be mounted on the outer surface of the antenna board 17 and a plurality of FPGAs 13 and RFICs 14 disposed to be mounted on the inner surface of the antenna board 17.

The FPGA 13 and the RFIC 14 among the plurality of communication elements 12 may be heat-generation elements generating predetermined heat when being electrically operated.

Meanwhile, the antenna board 17 may perform a function of a circuit board in which the plurality of communication elements 12 accommodated in the inner space of the heat-radiating combined case 10 and the antenna elements (not illustrated) are mounted on the inner surface and outer surface thereof, and perform a function of protecting the antenna element mounted on the inner surface from the outside. In this case, the heat-radiating mechanism 1 for the antenna device according to the exemplary embodiment of the present disclosure may further include a radome (not illustrated) protecting the antenna elements while surrounding the outer surface of the antenna board 17.

As illustrated in FIGS. 2 and 3, the plurality of heat-radiating ribs 30, 40 are produced by being integrally extruded with a body plate 11 of the heat-radiating combined case 10, and may include a plurality of extrusion heat-radiating ribs 30 disposed in multiple stages to be vertically spaced apart from each other at a predetermined distance such that empty spaces 15, 16 are formed in one side and the other side of the heat-radiating combined case 10 in the width direction, respectively, and a plurality of casting heat-radiating ribs 40 produced by a die casting to be coupled to the empty spaces 15, 16 between the plurality of extrusion heat-radiating ribs 30, and having a plurality of inclined ribs disposed to be inclined upward to the left and right outsides of the heat-radiating combined case 10 in the width direction, respectively, with respect to the center.

More specifically, the plurality of extrusion heat-radiating ribs 30 are produced by forming the heat-radiating rib illustrated in FIG. 1 described in the section of 'the Background Art' in the extrusion molding method, and are formed to be elongated in the longitudinal direction (i.e., the vertical direction) of the heat-radiating combined case 10 such that the plurality of empty spaces 15, 16 are formed in one side and the other side of the heat-radiating combined case 10 in the width direction.

Here, the plurality of extrusion heat-radiating ribs 30 may be vertically disposed in multiple stages without being vertically continuous by the empty spaces 15, 16.

Further, the empty spaces 15, 16 may be defined as one side empty space 15 formed on one side of the heat-radiating combined case 10 and the other side empty space 16 formed on the other side of the heat-radiating combined case 10, respectively.

The one side empty space 15 and the other side empty space 16 may be formed in an approximately right-angled triangular shape, and formed in a shape in which portions forming the right angle are connected to each other.

The plurality of casting heat-radiating ribs 40 produced by the die casting molding method may be coupled to the one side empty space 15 and the other side empty space 16 to be filled, separately from the plurality of extrusion heat-radiating ribs 30.

The plurality of extrusion heat-radiating ribs 30 may be produced by the method of being extruded and molded integrally with the body plate 11 configuring the skeleton of the heat-radiating combined case 10, whereas the plurality of casting heat-radiating ribs 40 may be produced by the die casting molding method separately from the body plate 11 to be coupled to the empty spaces 15, 16.

More specifically, as illustrated in FIGS. 3 and 4, the plurality of casting heat-radiating ribs 40 may include a first rib group 41 filled in the one side empty space 15 formed in the triangular shape on one side of the heat-radiating combined case 10 in the width direction and a second rib group 42 filled in the other side empty space 16 formed in the triangular shape on the other side of the heat-radiating combined case 10 in the width direction.

Here, it is preferable that the first rib group 41 and the second rib group 42 are integrally molded by the die casting. However, the first rib group 41 and the second rib group 42 need not necessarily be integrally formed, and may also be separately produced to be coupled to the one side empty space 15 and the other side empty space 16, respectively, through the general coupling method. In the heat-radiating mechanism 1 for the antenna device according to the exemplary embodiment of the present disclosure, the plurality of casting heat-radiating ribs 40 will be described by assuming that the first rib group 41 and the second rib group 42 are integrally formed.

Meanwhile, as illustrated in FIG. 4, the plurality of extrusion heat-radiating ribs 30 of the plurality of heat-radiating ribs 30, 40 may be disposed to be spaced apart from each other at a first separation distance (L1) in the width direction of the heat-radiating combined case 10, and the plurality of casting heat-radiating ribs 40 may be disposed to spaced apart from each other at a second separation distance (L2) to which each lower end of the plurality of casting heat-radiating ribs 40 is connected to each front end of the plurality of extrusion heat-radiating ribs 30.

Theoretically, since each lower end of the plurality of casting heat-radiating ribs 40 is connected to each front end of the plurality of extrusion heat-radiating ribs 30, the first separation distance (L1) and the second separation distance (L2) are the same as each other, but the first separation distance (L1) and the second separation distance (L2) are not necessarily required to be the same.

The plurality of casting heat-radiating ribs 40 of the plurality of heat-radiating ribs 30, 40 may be extensively formed such that each upper end thereof forms the end of the heat-radiating combined case 10 in the width direction.

That is, if the first rib group 41 of the plurality of casting heat-radiating ribs 40 is disposed to be filled in the one side empty space 15 formed in the left width direction of the heat-radiating combined case 10 in the figure, the upper end of the first rib group 41 is formed to have the length matched to the left end of the heat-radiating combined case 10 and may be formed to be inclined upward.

Further, if the second rib group 42 of the plurality of casting heat-radiating ribs 40 is disposed to be filled in the other empty space 16 formed in the right width direction of the heat-radiating combined case 10 in the figure, the upper end of the second rib group 42 is formed to have the length matched to the right end of the heat-radiating combined case 10 and may be formed to be inclined upward.

Meanwhile, at least one 42*a*, 42*b* of the plurality of casting heat-radiating ribs 40 may be disposed to connect the lower end of each rib of the plurality of extrusion heat-radiating ribs 30 disposed on the upper portion thereof. In the opposite interpretation, the lower end of the plurality of extrusion heat-radiating ribs 30 may be formed in a shape in which the lower end is in contact with at least one of the plurality of casting heat-radiating ribs 40.

Here, although not illustrated in the figure, one side surface of the body plate 11 provided with the plurality of communication elements 12 may be provided with a plurality of contact projections which are in direct contact with the respective communication elements 12. The plurality of contact projections are sufficiently understood as the component of transferring the heat generated by each of the plurality of communication elements 12 composed of the heat-generation element to the plurality of extrusion heat-radiating ribs 30 of the outside through the heat-radiating combined case 10.

Therefore, the heat received from each of the plurality of communication elements 12 heat-generated by the plurality of contact projections is transferred to the plurality of extrusion heat-radiating ribs 30 integrally formed on the outer surface of the body plate 11 to be heat-radiated. That is, when the heat-radiating structure is designed, the plurality of extrusion heat-radiating ribs 30 are preferably designed to be disposed in multiple stages to correspond to the plurality of communication elements 12 disposed on the opposite surface thereof.

The plurality of extrusion heat-radiating ribs 30 of the heat-radiating combined case 10 receive and radiate the heat from the plurality of communication elements 12, and form predetermined rising airflow by the heat-radiated heat. The rising airflow is not transferred toward the plurality of extrusion heat-radiating ribs 30 located on the upper portions of the casting heat-radiating ribs 40 by the casting heat-radiating ribs 40 located on the relatively upper position. As described above, this is because the rising airflow is exhausted to the outside of the heat-radiating combined case 10 in the width direction by at least one 42*a*, 42*b* of the plurality of casting heat-radiating ribs 40. Therefore, the rising airflow formed by being heat-radiated on the relatively lower side of the heat-radiating combined case 10 does not affect the plurality of extrusion heat-radiating ribs 30 provided on the relatively upper portions of the casting heat-radiating ribs 40.

Here, a shape of the line connecting the lower end of each rib of the plurality of extrusion heat-radiating ribs 30 may be a 'V' shape, and two ribs of the plurality of casting heat-radiating ribs 40 disposed on the uppermost end thereof may also be provided in a 'V' shape to connect each lower end of the plurality of extrusion heat-radiating ribs 30.

As illustrated in FIG. 4, the heat-radiating mechanism 1 for the antenna device according to the exemplary embodiment of the present disclosure composed of the above configuration transfers the heat to the plurality of extrusion heat-radiating ribs 30 through the contact projection provided to contact each of the plurality of communication elements 12 (e.g., the FPGA 13 having the largest heat-generation amount), and the plurality of extrusion heat-radiating ribs 30 radiate the heat received from the plurality of communication elements 12 in the method of being heat-exchanged with the outside air.

The heat discharged through the plurality of extrusion heat-radiating ribs 30 may rise through an air flow path provided between the respective extrusion heat-radiating ribs of the plurality of extrusion heat-radiating ribs 30 while forming the rising airflow in the natural convection state, and be exhausted to one side or the other side of the heat-radiating combined case 10 in the width direction through a space between the respective casting heat-radiating ribs of the plurality of casting heat-radiating ribs 40.

Therefore, the heat-radiating mechanism 1 for the antenna device according to the exemplary embodiment of the present disclosure may radiate the heat generated by the respective communication elements 12 to the outside through the plurality of extrusion heat-radiating ribs 30, thereby eliminating the heat-radiating deviation according to the vertical height of the heat-radiating combined case 10 produced in the form of the vertically longitudinal slim-type case.

Figure 5:
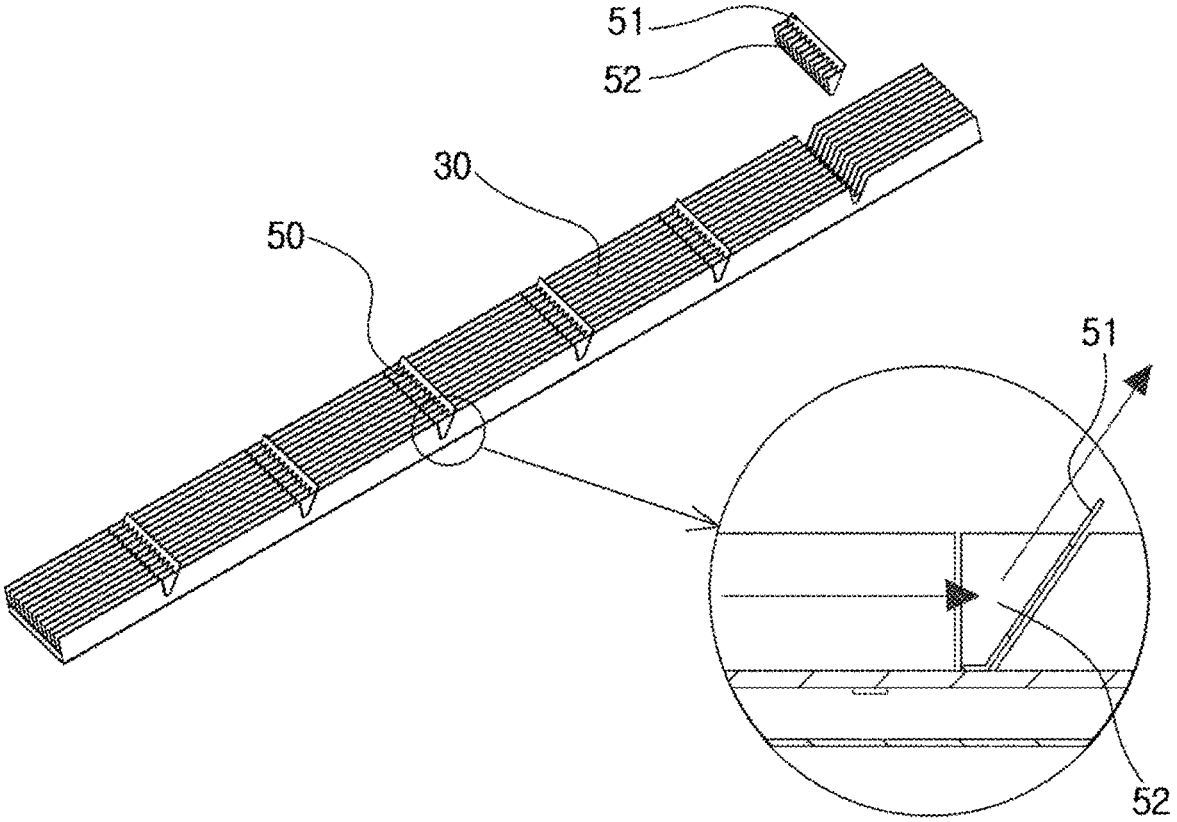
FIG. 5 is a perspective diagram and a partial cross-sectional diagram of a Comparative Example for the heat-radiating performance comparison with the heat-radiating mechanism for the antenna device according to the present disclosure.

The applicant of the present disclosure designed a Comparative Example illustrated in FIG. 5 as the Comparative Example thereof, in order to confirm that the heat-radiating mechanism 1 for the antenna device according to the exemplary embodiment of the present disclosure has the optimal heat-radiating performance.

Figure 7:
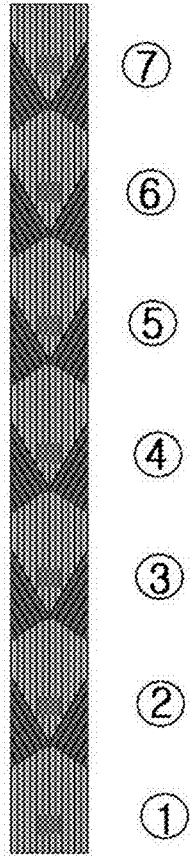
FIG. 7 is a diagram illustrating comparison data for comparing the heat-radiating performance between the heat-radiating mechanism for the antenna device according to the present disclosure and the heat-radiating mechanisms according to the related art and the Comparative Example.
Figure 8:
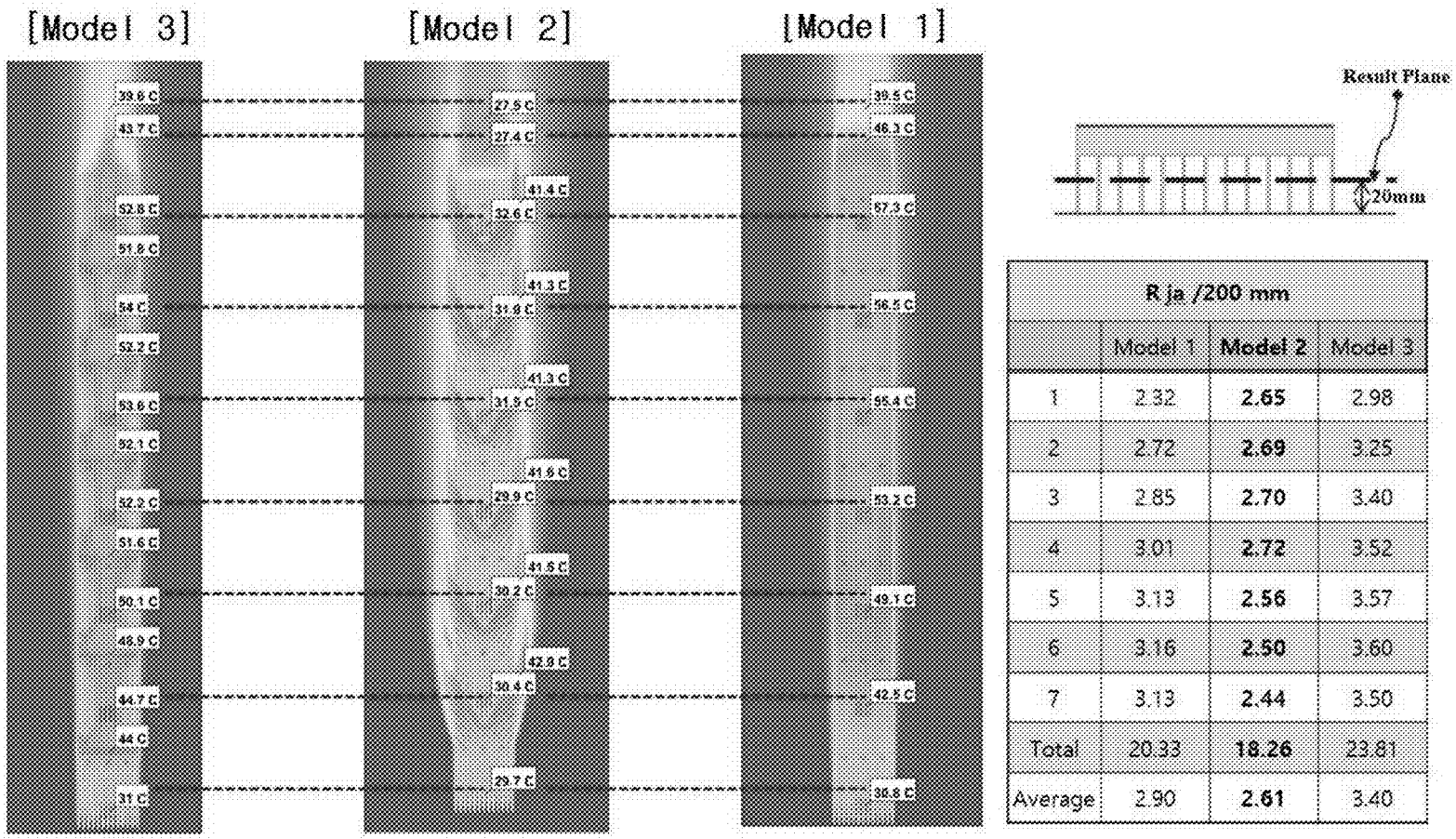
FIG. 8 is a heat distribution diagram and a result table for comparing the thermal resistance values between the heat-radiating mechanism for the antenna device according to the present disclosure and the heat-radiating mechanisms according to the related art and the Comparative Example.

FIG. 5 is a perspective diagram and a partial cross-sectional diagram of a Comparative Example for the heat-radiating performance comparison with the heat-radiating mechanism 1 for the antenna device according to the present disclosure, FIG. 6 is a table illustrating experimental conditions for comparing the heat-radiating performance of the heat-radiating mechanism 1 for the antenna device according to the present disclosure, FIG. 7 is a diagram illustrating comparison data for comparing the heat-radiating performance between the heat-radiating mechanism for the antenna device according to the present disclosure and the heat-radiating mechanisms according to the related art and the Comparative Example, and FIG. 8 is a heat distribution diagram and a result table for comparing the thermal resistance values between the heat-radiating mechanism 1 for the antenna device according to the present disclosure and the heat-radiating mechanisms according to the related art and the Comparative Example.

Hereinafter, the description will be made by indicating the heat-radiating mechanism 1 for the antenna device according to the example of the related art already described in the section of 'the Background Art' as a 'Model 1', indicating the heat-radiating mechanism 1 for the antenna device according to the exemplary embodiment of the present disclosure as a 'Model 2', and indicating the Comparative Example to be additionally described with reference to FIG. 5 as a 'Model 3'.

As illustrated in FIG. 5, the Comparative Example implemented by the Model 2 may include the plurality of extrusion heat-radiating ribs 30 formed in the vertically longitudinal direction of the heat-radiating combined case 10, and disposed to be vertically spaced apart from each other in multiple stages, and an air baffle 50 disposed in the separation space of the plurality of extrusion heat-radiating ribs 30, and disposed to exhaust the rising airflow formed from the lower end of the heat-radiating combined case 10 toward the back surface of the heat-radiating combined case 10.

The method for producing the plurality of extrusion heat-radiating ribs 30 follows the method of the Model 2 implemented according to the exemplary embodiment of the present disclosure, but there is a difference in that the Model 3 has the air baffle 50 which exhausts the rising airflow toward the back surface of the heat-radiating combined case 10 rather than to the outside of the heat-radiating combined case 10 in the width direction.

Here, the air baffle 50 may be coupled such that the air baffle 50 produced by the die casting molding method is filled in each separation space of the plurality of extrusion heat-radiating ribs 30 produced by the extrusion molding method.

That is, the plurality of extrusion heat-radiating ribs 30 may be produced by the method of being extruded and molded integrally with the body plate 11 configuring the skeleton of the heat-radiating combined case 10, whereas the air baffle 50 may be produced by the die casting molding method separately from the body plate 11 to be coupled to the separation space.

The air baffle 50 may include an inclined exhaust plate 51 disposed to be inclined upward toward the back surface of the heat-radiating combined case 10 to shield each lower end of the plurality of extrusion heat-radiating ribs 30, and a plurality of induction heat-radiating ribs 52 connected to the upper end of the plurality of extrusion heat-radiating ribs 30 disposed on the lower side thereof, and inducing the rising airflow to the inclined exhaust plate 51.

Therefore, as illustrated in FIG. 5, in the case of the Comparative Example implemented by the Model 3, the rising airflow formed by being heat-radiated through the plurality of extrusion heat-radiating ribs 30 rises through the air flow path between the respective extrusion heat-radiating ribs of the plurality of extrusion heat-radiating ribs 30, and then rises through the plurality of induction heat-radiating ribs 52 of the air baffle 50 and then is exhausted toward the back surface of the heat-radiating combined case 10 through the inclined exhaust plate 51.

However, the rising airflow exhausted toward the back surface of the heat-radiating combined case 10 through the inclined exhaust plate 51 in the Model 3 is different depending on the natural convection state but there is a concern in that the rising airflow is introduced into the plurality of extrusion heat-radiating ribs 30 located on the upper portion of the heat-radiating combined case 10 again while additionally rising.

The applicant of the present disclosure confirmed the results illustrated in FIGS. 7 and 8 after the experiment under the experimental conditions illustrated in FIG. 6 in order to confirm each heat-radiating performance of the heat-radiating mechanism 1 for the antenna device implemented by the aforementioned Model 1, Model 2, and Model 3.

Referring to FIG. 7, the FPGA 13, which is one of the heat-generation elements, was provided at seven places, and as the result of measuring the temperature for each point by giving numbers 1 to 7 from the lower end to the upper end, it could be confirmed that in the Model 1, the temperature deviation between the number 1, which is the lower end, and the number 7, which is the upper end, was about 6° C., whereas in the Model 2, the temperature deviation of 1.8° C. occurred.

Further, it could be seen that considering that in the Model 3, the temperature deviation of 3.3° C. occurred, it was not the optimal heat-radiating design. As described above, this is interpreted as because, in the Model 3, the rising airflow exhausted toward the back surface of the heat-radiating combined case 10 is different depending on the natural convection state but introduced into the plurality of extrusion heat-radiating ribs 30 located on the upper portion of the heat-radiating combined case 10 again while additionally rising.

Further, referring to FIG. 8, it may be seen that the most preferable result value for each thermal resistance value of the portion provided with the FPGA 13 was also secured in the Model 2. It may be confirmed that the slight thermal resistance value deviation exists at each point provided with the FPGA 13, but at the same time, the lowest value was secured in the Model 2 in terms of the average value of all of the thermal resistance values. For reference, to secure the reasonable thermal resistance value from the Model 1 to the Model 3, as illustrated in FIG. 8, the point, which was 20 mm from the front end of the plurality of extrusion heat-radiating ribs 30 of the plurality of heat-radiating ribs, was commonly measured.

As described above, the heat-radiating mechanism for the antenna device according to the exemplary embodiment of the present disclosure has been described in detail with reference to the accompanying drawings. However, the exemplary embodiment of the present disclosure is not necessarily limited to the aforementioned exemplary embodiment, and it is natural that various modifications and the practice within the equivalent scope are possible by those skilled in the art to which the present disclosure pertains. Therefore, the true scope of the present disclosure will be defined by the claims to be described later.

INDUSTRIAL APPLICABILITY

The present disclosure provides the heat-radiating mechanism for the antenna device which may minimize the vertical heat-radiating deviation in the antenna device composed of the vertically longitudinal slim-type case body, thereby improving the antenna performance.

The invention claimed is:

1. A heat-radiating mechanism for the antenna device comprising:

a plurality of communication elements generating predetermined heat upon electrical operation;

a heat-radiating combined case having the plurality of communication elements accommodated in one surface thereof and a plurality of heat-radiating ribs integrally formed on the other surface thereof, and formed to be vertically and longitudinally elongated; and an antenna board mounted with the plurality of communication elements on one surface of the heat-radiating combined case, wherein the plurality of heat-radiating ribs are formed such that the rising airflow formed by being heat-radiated from the relatively lower portion of the heat-radiating combined case is exhausted to be inclined upward to the left and right outsides of the heat-radiating combined case in the width direction from the relatively upper position.

2. The heat-radiating mechanism for the antenna device of claim 1, wherein the plurality of heat-radiating ribs comprise:

a plurality of extrusion heat-radiating ribs disposed in multiple stages to be vertically spaced apart from each other at a predetermined distance such that an empty space is formed in each of one side and the other side of the heat-radiating combined case in the width direction; and a plurality of casting heat-radiating ribs produced by a die casting method to be coupled to the empty space between the plurality of extrusion heat-radiating ribs, and having a plurality of inclined ribs disposed to be inclined upward to the left and right outsides of the heat-radiating combined case in the width direction, respectively, with respect to the center.

3. The heat-radiating mechanism for the antenna device of claim 2, wherein the plurality of extrusion heat-radiating ribs of the plurality of heat-radiating ribs are disposed to be spaced apart from each other at a first separation distance in the width direction of the heat-radiating combined case, and wherein the plurality of casting heat-radiating ribs are disposed to be spaced apart from each other at a second separation distance to which each lower end of the plurality of casting heat-radiating ribs is connected to each front end of the plurality of extrusion heat-radiating ribs.

4. The heat-radiating mechanism for the antenna device of claim 3, wherein the plurality of casting heat-radiating ribs of the plurality of heat-radiating ribs are extensively formed such that each upper end is matched to one end and the other end of the heat-radiating combined case in the width direction.

5. The heat-radiating mechanism for the antenna device of claim 4, wherein at least one of the plurality of casting heat-radiating ribs is disposed to connect the lower end of each rib of the plurality of extrusion heat-radiating ribs disposed on the upper portions thereof.

6. The heat-radiating mechanism for the antenna device of claim 2, wherein the empty space formed between the plurality of extrusion heat-radiating ribs is formed in a triangular shape.

7. The heat-radiating mechanism for the antenna device of claim 6, wherein the plurality of casting heat-radiating ribs comprise:

a first rib group filled in one side empty space formed in the triangular shape on one side of the heat-radiating combined case in the width direction; and a second rib group filled in the other side empty space formed in the triangular shape on the other side of the heat-radiating combined case in the width direction, and wherein the first rib group and the second rib group are integrally molded by a die casting.

8. The heat-radiating mechanism for the antenna device of claim 2, wherein a shape of the lower end formed by each rib of the plurality of extrusion heat-radiating ribs is provided in a 'V' shape, and wherein two ribs of the plurality of casting heat-radiating ribs disposed on the uppermost end thereof are provided in a 'V' shape to connect each lower end of the plurality of extrusion heat-radiating ribs.

* * * * *